United States Patent [19]

Carrillo

[11] Patent Number: 4,930,662

[45] Date of Patent: Jun. 5, 1990

[54] FLEXIBLE PLATE DISPENSER AND IMPROVED FLEXIBLE PLATE

[76] Inventor: Louis D. Carrillo, 6611 Rostrata, Buena Park, Calif. 90621

[21] Appl. No.: 365,918

[22] Filed: Jun. 14, 1989

Related U.S. Application Data

[63] Continuation of Ser. No. 298,655, Jan. 18, 1989, abandoned, which is a continuation of Ser. No. 69,292, Jul. 2, 1987, abandoned.

[51] Int. Cl.[5] ..... B65H 1/00

[52] U.S. Cl. ..... 221/45; 221/63; 221/283; 312/42

[58] Field of Search ..... 221/282, 283, 61, 63, 221/303, 309, 310, 45; 312/42, 43, 243

[56] References Cited

U.S. PATENT DOCUMENTS

| | | | |
|---|---|---|---|
| 1,134,651 | 4/1915 | Tramell . | |
| 1,388,977 | 8/1921 | Stephens | 221/283 |
| 1,424,517 | 8/1922 | Potts . | |
| 1,541,532 | 6/1925 | Simmons . | |
| 1,564,529 | 12/1925 | Carter . | |
| 1,565,306 | 12/1925 | Bergman et al. . | |
| 1,922,122 | 8/1933 | Carew | 65/61 |
| 2,115,923 | 5/1938 | Cooper | 312/42 |
| 2,358,709 | 9/1944 | Hayn | 312/43 |
| 2,496,812 | 2/1950 | Perelman | 312/43 |
| 3,338,646 | 8/1967 | Harvey | 312/42 |
| 3,930,698 | 1/1976 | Colgan | 312/43 |
| 4,094,443 | 6/1978 | Whelan | 221/63 |
| 4,483,460 | 11/1984 | Whelan | 221/303 |
| 4,550,856 | 11/1985 | Ballmann et al. | 221/63 |
| 4,643,342 | 2/1987 | Steele | 221/63 |

*Primary Examiner*—H. Grant Skaggs

*Attorney, Agent, or Firm*—Stetina and Brunda

[57] ABSTRACT

A canister container holds stacked flexible dishes, nominally plates, in their normal upright orientation in position above a large, roughly circular, central bottom aperture to such canister. The plates are supported in this position within the canister by an inwardly-directed peripheral flange extending approximately 230 degrees around the circumference of the bottom aperture which engages the edge margin of a bottom one of the stacked flexible plates. The stacked flexible plates are also supported in this position by at least one, and preferably two, inwardly-directed peripheral tabs which are situated about the bottom aperture of the canister at positions opposite to the flange. The canister also preferably has a second aperture in its cylindrical sidewall between and above the location of the two tabs to the bottom aperture. Selected bottom ones of the stacked flexible plates may be slightly temporarily warped or deformed by manual force applied through the second aperture to pass beyond supporting engagement with the tabs. The flexible plates are then slid laterally from the canister through its bottom aperture until they no longer engage the flange. Storage and dispensing of flexible plates is thereby performed.

9 Claims, 2 Drawing Sheets

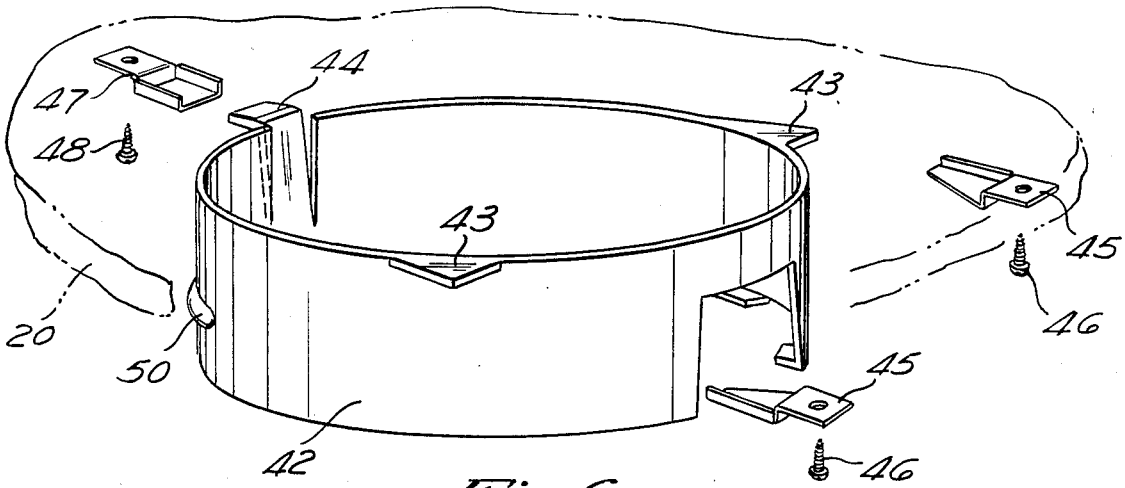
Fig. 6
Fig. 7
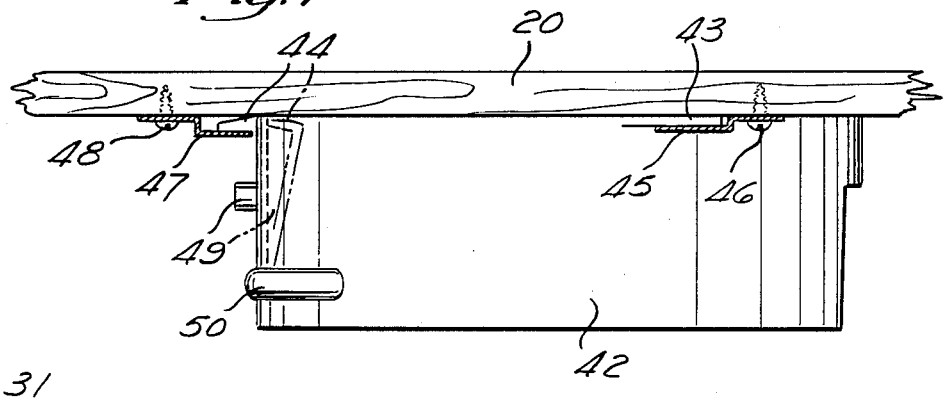
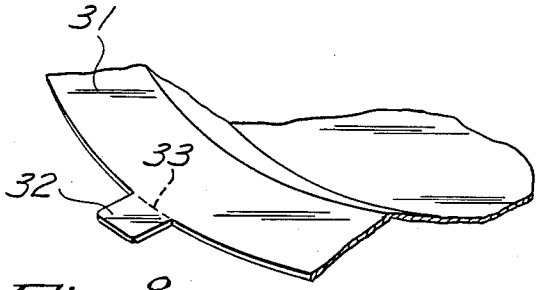
Fig. 8
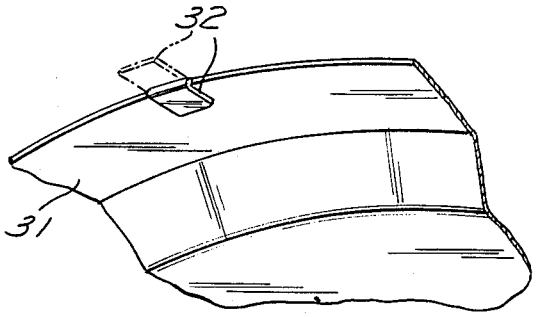
Fig. 9
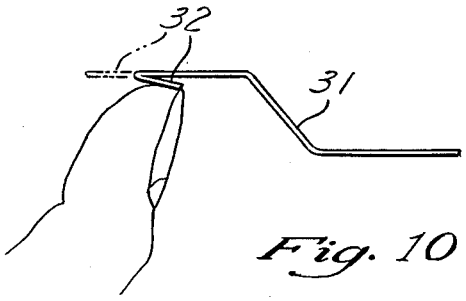
Fig. 10

FLEXIBLE PLATE DISPENSER AND IMPROVED FLEXIBLE PLATE

RELATED APPLICATIONS

This application is a continuation application of U.S. Ser. No. 07/298,655 (now abandoned), filed Jan. 18, 1989, which is a continuation of U.S. Ser. No. 07/069,292 (now abandoned), filed Jul. 2, 1987.

BACKGROUND OF THE INVENTION

The present invention concerns holders and dispensers for disposable paper or plastic flexible plates, bowls, or other similar disposable dishware items. Flexible dish holders and dispensers in accordance with the present invention are particularly suitable for home, i.e. residential consumer use.

A holder and dispenser of flexible dishes, serving bowls, and the like should meet several requirements. The holder and dispenser should be simple and foolproof to load. It should reliably dispense selected quantities of disposable dishes, even when operated by children. The dishes should be maintained in sanitary conditions during storage and during dispensing. It is preferable that the holder and dispenser should be washable and hold and dispense the flexible dishes without inducing any permanent deformation of such dishes.

It is preferred that a flexible dish holder and dispenser should be durable, and simple in construction, and inexpensive in cost. It should be practical of being situated within a residential kitchen, and should be aesthetically appealing in such environment. It should be readily installable by the residential user and be maintenance free.

Certain holders and dispensers of both flexible and non-flexible plates and dishes exist within the prior art. These holders and dispensers are generally directed to the restaurant and food service trade and are typically large, expensive and cumbersome. U.S. Pat. No. 2,358,709 for CONTAINER to Hayn shows a substantially cylindrical container having a slot in its side. A finger may be inserted through this slot for withdrawing an article of dishware. The container also has a top which is also provided with a slot extending inwardly from its edge. The top may be placed so as to form a continuation of the slot in the container to further facilitate withdrawal of articles from the container without removing the top therefrom.

Additionally pertinent to the present invention is U.S. Pat. No. 3,930,698 for PLATE HOLDER AND DISPENSER issued to Colgan. A paper plate dispenser shown by Colgan houses a stack of plates and is provided with specially formed openings in its bottom wall and sidewalls to enable one or more of the plates to be removed. The stack of plates is supported, in a bottom-down configuration, by a central portion of a bottom wall which is defined in part by an arcuate cut-out portion and which supports the stack of plates at their center. The arcuate cut-out portion exposes a significant marginal portion of the lowermost plate or bowl in the stack. Furthermore, the sidewall is provided with a slot in communication with the arcuate cut-out to facilitate manual gripping of the edges of a number of plates desired to be removed. The interior of the housing includes a plurality of brush-like retainers which engage selected regions of the stacked plates in an attempt to insure that remaining plates in the stack are not inadvertently drawn out of the housing together with those plates which are intentionally removed. The plate holder and dispenser may be mounted in either a vertical or horizontal orientation, including in a horizontal orientation suspended beneath a cabinet. In this underslung mounting a top cover is securely fastened to the underside of the cabinet while a bottom cylindrical section may be selectively attached to this cover in order to allow the dispenser to be loaded and reloaded. The cylindrical bottom section attaches to its top cover by vertically-extending fasteners upon an upper flange of the cylinder. These fasteners extend into corresponding complementary keyhole apertures within a corresponding horizontally-extending flange of the cover.

The particular prior art plate holder and dispenser taught within U.S. Pat. No. 3,930,698 employs an extensive number of elements in support of its storage and dispensing functions. Particularly, because the plates or bowls contained within the dispenser are supported by a central hub portion formed integrally with the bottom wall of the device (which bottom wall plate additionally includes an arcuate opening extending for more than a 180 degree arc), the selective retention of plates and the like within the dispenser is complex. Particularly, the retention is aided by brush-like retainers which engage selected regions of the stacked plates. These retainers are complex and expensive, subject to variation during manufacture and use, and collect contamination. Consequently, it is desired that a more effective plate holder and dispenser should be provided which is simple and reliable for performing the retention and selective dispensing function and would does require numerous structural element operation.

SUMMARY OF THE INVENTION

The present invention is embodied in a holder and dispenser for flexible dishes or plates such as are commonly made of paper, plastic, or urethane foam. The holder-dispenser in accordance with the present invention stores a multiplicity of such dishes in an axially stacked configuration, and in a manner which facilitates ready manual insertion and dispensing of the precise number of dishes desired.

In one embodiment the holder-dispenser in accordance with the present invention includes a cylindrical canister container having a top housing member, or lid, adapted to be mounted via one or more screw fasteners or the like to the horizontal lower surface of a kitchen cabinet or support surface. The cylindrical canister container further includes a bottom housing member which is adapted to be removably attached to the top housing member via fasteners, preferably via bayonet-type connectors. The lower edge of the this bottom housing member includes an annular rim, or flange, which extends radially inward a short distance and which extends about an approximate 230 degree arcuate portion of the canister container. The lower edge of the bottom housing member further includes at least one, and nominally two, tabs which also extend radially inward a short distance. The tabs are positioned symmetrically opposite the flange.

The cylindrical canister container, in the element of its bottom housing member having a inwards-directed peripheral flange and at least one tab, defines a substantially circular bottom aperture. This aperture is nearly as large as the diameter of the flexible dish, nominally a flexible plate, which is stored within the container. The flange and the at least one tab are co-operatively interactive to hold and support the flexible dishes in an axial stack within the canister by engaging the rim of a bottom one dish within the stack.

In order to dispense the flexible dishes selected, bottom ones of the flexible dishes are manually grasped between a finger and thumb of a user and manually forced downwardly by moderate deformation or warpage to pass beyond engagements with the tab and annular flange. The dishes are then slid laterally from the canister through its bottom aperture until they no longer engage the flange. The manually induced warping of the flexible dishes in order to enable their removal is only slight and temporary, and induces no permanent deformation.

Access to the stacked flexible dishes for manually grasping, and for warping, selective bottom ones of such dishes is optionally facilitated by an aperture formed within the sidewall of the lower housing member of the cylindrical canister container. The flexible dishes may optionally incorporate integral, flexible rim tabs which better facilitate manual grasping for extraction from the dispenser.

When preferably molded from plastic, the plate holder and dispenser in accordance with the present invention is low cost, lightweight, easily mounted, easily loaded, easily and reliably operated for extraction of flexible dishes stored therein, durable, sanitary, and aesthetically pleasing in design. The superior configuration of the bottom aperture defined by the flange and tab surfaces particularly supports a reliable and repetitively performable dispensing operation.

BRIEF DESCRIPTION OF THE DRAWINGS

These and other aspects and attributes of the present invention will become increasingly clear upon reference to following drawings wherein:

FIG. 6 is a perspective view showing a second embodiment of the flexible dish dispenser in accordance with the present invention.

FIG. 7 is a side view, partially in cross section, particularly showing the manner of affixing the second embodiment of the flexible dish dispenser to an underside of a kitchen cabinet or the like.

FIG. 8 is a perspective view showing a tab which is optionally formed upon the rims portion of flexible dishes used within either embodiment of the flexible dish dispenser in accordance with the present invention.

FIG. 9 is a perspective view showing the flexible dish tab previously seen in FIG. 7 disposed in its normal, folded-back, orientation.

FIG. 10 is a side view showing the flexible dish tab previously seen in FIGS. 8 and 9 being unfolded by a human finger preparatory to extraction of the flexible dish from the flexible dish dispenser in accordance with the present invention.

DESCRIPTION OF THE PREFERRED EMBODIMENT

The present invention is concerned with the dispensing of disposable flexible dishes, particularly flexible plates which are normally made from paper, plastic or foam material. A preferred first embodiment of a flexible dish dispenser apparatus in accordance with the present invention is generally shown in FIGS. 1–5. The flexible dish dispenser 10 in accordance with the present invention is shown mounted in its normal operative position, nominally depending downwardly from the base of a residential kitchen cabinet 20.

Figure 1:
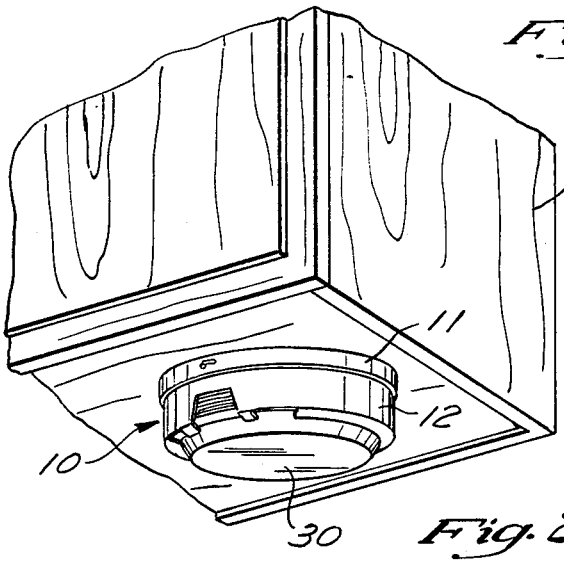
FIG. 1 is a perspective view showing a preferred first embodiment of a flexible dish dispenser in accordance with the present invention disposed in an operational environment under a residential kitchen cabinet.
Figure 2:
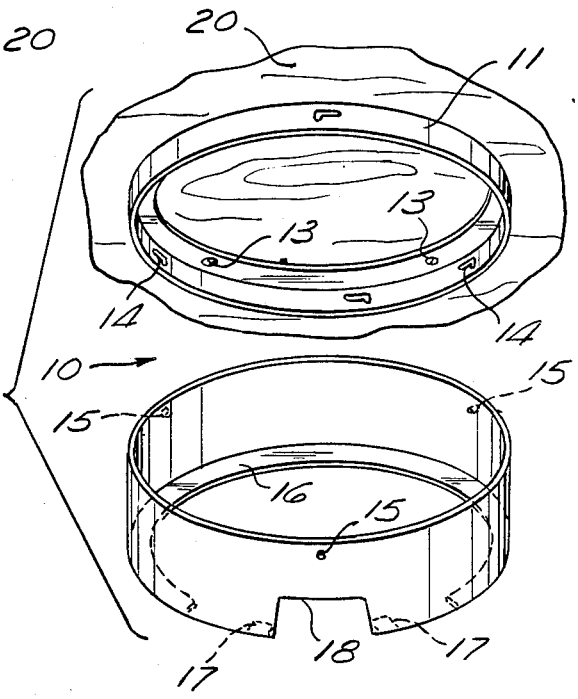
FIG. 2 is an exploded perspective view showing the first embodiment of the flexible dish dispenser in accordance with the present invention.

An exploded view of the first embodiment of the dispenser 10 is shown in FIG. 2. An upper housing member or top 11, substantially in the form of an annular ring, engages and retains a cylindrical canister 12 within which conventional paper dishes i.e. plates 30 (shown in FIGS. 1, 4, and 5) are housed. The mount 11 is affixed to a surface, such as the lower surface of cabinet 20 (shown in FIG. 1) by fasteners, nominally screws (not shown) which extend through apertures 13. The mount 11 also possesses a downwardly directed peripheral flange possessing a plurality, nominally three, bayonet apertures 14. These bayonet apertures 14 engage complementary sized posts 15 which extend radially outward upon the external circumference of cylindrical canister 12. The manner of such engagement is that the cylindrical canister 12, and posts 15 thereon, are raised into the flange of the annular ring 11, and into the bayonet apertures 14 therein. The cylindrical canister 12 is then twisted, i.e. rotated relative to the mount 11, causing a locking engagement or retention between the complementary post and aperture features.

Figure 3:
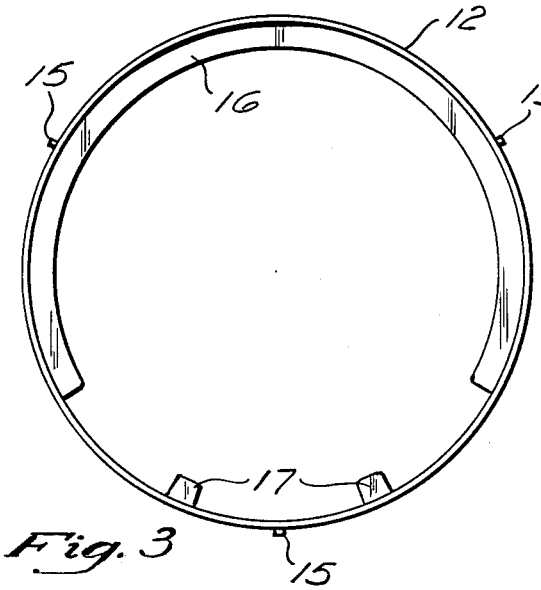
FIG. 3 is a bottom view showing the flange and tab structure of a cylindrical canister member of the first embodiment of the flexible dish dispenser in accordance with the present invention.

Continuing in FIGS. 2 and 3, the cylindrical canister 12 defines a large, essentially circular and essentially concentric, central bottom aperture. This aperture is partially defined by an inwards-directed peripheral flange 16 which extends about an arcuate portion of the bottom edge of the cylindrical canister 12. This arcuate portion is preferably greater than 180 degrees, and is less than 268 degrees, and is optimally approximately 230 degrees of the total circumference of cylindrical canister 12. The peripheral flange 16 extends inward sufficiently far so as to engage the rim of the flexibile dishes which are stacked and stored within the cylindrical canister 12. For example, if nine inch diameter paper plates are stacked within cylindrical canister 12, which then has a corresponding interior diameter of slightly greater than nine inches, then the width of peripheral flange 16 is approximately one third inch.

Also presented by the cylindrical canister 12 at the edge of its large bottom aperture are at least one, and preferably two radially inward-directed peripheral tabs 17. These tabs 17 are preferably situated opposite to and symmetrical with the flange 16.

The cylindrical canister 12 optionally presents a side aperture 18, nominally situated centrally between the tabs 17. This optional side aperture 18 facilitates finger access to the flexible plates 30 stored within the canister 12. The side aperture 18 may extend axially upward upon the cylindrical surface of canister 12 to any appropriate height, but normally extends through a distance of approximately one inch. The total nominal height to cylindrical canister 12 is approximately three inches thereby facilitating the storage of a quantity of approximately one-hundred conventional nine inch diameter plates.

Figure 5:
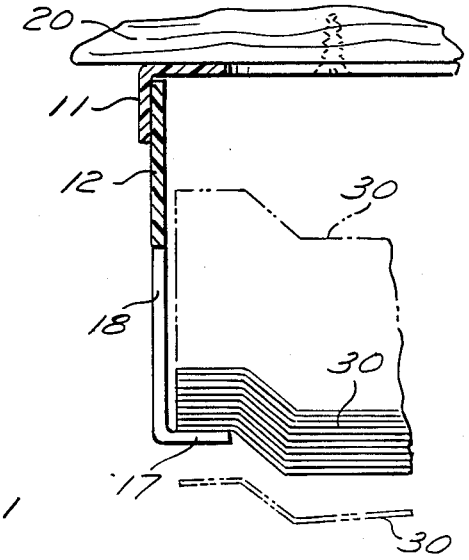
FIG. 5 is a cross-sectional view showing the manner of loading flexible dishes, particularly plates, within the first embodiment of the flexible dish dispenser in accordance with the present invention.
Figure 4:
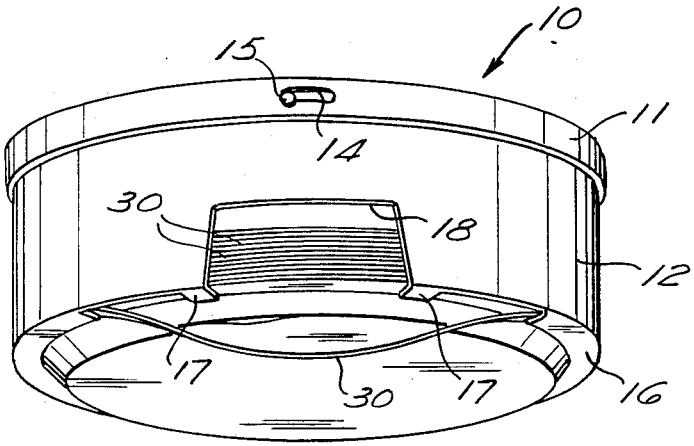
FIG. 4 is a diagrammatic view of the dispensing of a flexible dish, particularly a plate, from the first embodiment of the flexible dish dispenser in accordance with the present invention.

The manner of holding and dispensing flexible dishes 30 from the dispenser 10 in accordance with the present invention is shown in FIGS. 4 and 5. The flexible dishes 30 are loaded, i.e. inserted within the cylindrical canister 12 and are maintained therein by the support surfaces collectively provided by flange 16 and tabs 17. At such times as a lowermost one or ones of the flexible dishes 30 are to be dispensed, then the rim edge portion of such dishes is grasped by a human finger or thumb and pulled downwardly past the tabs 17. Finger contact with the flexible dishes 30 for this preliminary extraction may be facilitated by access through optional side aperture 18. The resilient, i.e. warpage action of the flexible dishes 30 readily permits the edge portion of the dishes to be pulled downwardly beyond engagement with the tabs 17. The one or ones of the disengaged flexible dishes 30 are then slid radially outward from the cylindrical canister 12 through its bottom aperture until their edge or rim no longer engages the flange 16 and are completely extracted.

Such slight warping or moderate edge deformation of the flexible dishes as needs be performed during their extraction is only temporary, and results in no permanent deformation of even the stiffest and most fragile of such dishes. The dispensing is simple and reliable and permits desired selection and dispensing of either single or multiple dishes at one time. In this regard, due to the edge portion of each dish being visable through the aperture 18, a user may readily dispense a desired number of dishes merely by counting and grasping such desired number.

A second embodiment of the flexible dish dispenser in accordance with the present invention is illustrated in FIGS. 6 and 7. This second embodiment comprises a one piece embodiment and particularly exhibits an additional manner of facilitating mounting to a surface, nominally the underside surface of cabinet 20 (shown in FIG. 1). Particularly, the cylindrical canister 42, which corresponds to and is generally formed in an analogous manner to the cylindrical canister 12 within the first embodiment of the invention, may be seen to exhibit fixed mounting lugs 43 and a flexible retention lug 44. The lugs 43 are sized to be retained within complementary shaped clip fasteners 45 which may be affixed to a mounting surface by fasteners, fasteners nominally screws, 46. The lugs 43 are capable of sliding within the saddle-like surfaces of clips 45, which thereafter prevent the canister 42 from relative side to side movement therein. An additional retainer clip 47 is mounted to the cabinet by another screw 48 and is disposed opposite the flexible retention lug 44. This clip 47 is positioned, as may be most clearly observed in FIG. 7, so that flexible retention lug 44 will engage it, thereby retaining the canister 42 in its mounted position, unless such flexible lug 44 is manually pressed inwardly toward the central axis of cylindrical canister 42. The manual locating of flexible retention 44, and its inwards depression, may be particularly aided by knob 49. The flexible lug 44 preferably hinges on a living hinge, integrally molded with the plastic body of cylindrical canister 42, which is strengthened by an area 50 of increased thickness. The second embodiment of the flexible dish dispenser in accordance with the present invention stores flexible dishes, and dispenses these flexible dishes through its bottom aperture, in an analogous manner to that described in relation to the first embodiment.

Although standard sized conventional disposable dishes may be readily used in the flexible plate dispenser of the present invention, an optional adaptation of flexible dishes to enhance their use within either embodiment of the flexible dish holder and dispenser in accordance with the present invention is generally shown in FIGS. 8–10. A flexible dish, i.e. plate 31 includes an edge tab 32 which is normally formed integrally with such flexible dish 31. The tab is normally folded along bend, or score, line 33 into a folded-back position under the rim of flexible dish 31. In such folded-back position the tab 32 does not interfere with conventional axial stacking and packaging of the plates 31 for sale, or the loading of plates 31 into the cylindrical flexible dish holder and dispenser in accordance with the present invention. The flexible dishes 30 are preferably so loaded in an orientation so that tabs 32 are disposed within the area of aperture 18 (shown in FIG. 4). During extraction of one or ones of the flexible dishes 31, a human's finger may unfold the tab 32 as illustrated in FIG. 10, thereby obtaining a tab pull. This tab pull may be used to better facilitate the grasping and extraction of one or ones of the flexible dishes 31 from the holder and dispenser apparatus in accordance with the present invention. The tabs 32 are not necessary for the full and correct operation of the holder and dispenser apparatus in accordance with the present invention, but they are fully compatible with this operation.

In accordance with the preceding explanation the present invention has been seen to present a simplified construction, embodying improved aperature geometries, for the storage, and for the dispensing, of flexible dishes. Certain variations in the dispenser apparatus implemented in accordance with the principles of the present invention are obviously possible without departing from the true spirit and scope of the invention. For example, the numbers of tabs 17 can be varied, and the flange 16 could be divided into separate arcuate portions. For example, it not required that the tabs 17 exhibit moderate flexibility to accomodate the dispensing of non-flexible plates. For example, the tabs 17 could be made highly flexible, possibly even being mounted on a living hinge similarly to the flexible retention lug 44 within the second embodiment of the invention, in order to facilitate the clearance of the dishes past these tabs during the dispensing operation.

In accordance with these and other obvious variants, the present invention should be perceived to be of broad scope. Particularly, it should be defined by the language of the following claims, only, and not solely in accordance with those two preferred embodiments within which the invention has been taught.

What is claimed is:

1. A dispenser for flexible plates comprising:

a generally cylindrical container sized for storing stacked flexible plates in an upright vertical orientation the container formed having an interior region substantially complimentary to the periphery of the stacked flexible plates and including a generally cylindrical bottom aperture sized to permit the central portion of selected bottom ones of said stacked flexible plates to extend therethrough;

a peripheral flange formed about a substantial portion of the bottom aperture of the container to provide a guide surface for sliding selected bottom ones of said stacked plates radially outward from said container, said flange extending radially inward therefrom through a distance sufficient to engage the peripheral edge portion of a bottom one of the stacked plates in a generally contiguous orientation and support the stacked plates within the interior region;

at least one tab formed at the bottom aperture of the container, disposed between opposite ends of the flange and extending radially inward through a distance sufficient to engage the peripheral edge portion of the bottom one plate;

wherein the bottom aperture, the flange, and the at least one tab permit selected bottom ones of the stacked flexible plates to be manually grasped at their peripheral edge portion adjacent said at least one tab and be warped in order to cause such plates to pass downwardly beyond engagement with the at least one tab, and may then be slid radially outward along the guide surface of said peripheral flange from the container through its bottom aperture until they no longer engage the flange.

2. The dispenser according to claim 1 further comprising:

a side aperture formed within a sidewall of the container and extending into the bottom aperture, through which side aperture a region of the edge portion of the selected bottom ones of the stacked flexible plates are exposed;

wherein manual access may be obtained through the side aperture for warping the selected bottom ones of the stacked flexible plates in order to cause such plates to pass beyond engagement with the at least one tab.

3. The dispenser according to claim 2 wherein the at least one tab comprises:

two tabs each positioned on opposite sides of the side aperture.

4. The dispenser according to claim 3 further comprising means for removably mounting said canister to a support surface.

5. The dispenser according to claim 1 wherein the container comprises:

a substantially cylindrical canister body having a substantially circular central aperture at both ends;

a top lid to the canister body having a downwards directed bottom flange; and complementary fittings which are upon a flange of the lid and a sidewall of the tubular canister body for attaching the lid to the body.

6. The dispenser according to claim 5 wherein the complementary fittings comprise:

a plurality of posts; and a corresponding plurality of bayonet apertures.

7. A method of stowing and dispensing flexible plates in a container formed having an interior region substantially complimentary to the periphery of said flexible plate, a bottom aperture and a peripheral flange formed about the bottom aperture to provide a guide surface for sliding said flexible plate radially outward from said container, comprising:

inserting a plurality of stacked flexible plates in an upright vertical orientation within the cylindrical container so as to engage the peripheral flange extending radially inward about a substantial portion of a bottom aperture of the container and also so as to engage a peripheral tab extending radially inward at another portion of the bottom aperture of the container wherein the plates are supported upon the flange and upon the tab with the central portion of selected bottom ones of said stacked plates extending downwardly through said aperture;

grasping the peripheral edge portion of at least one of the plates at the bottom of the stack through a side aperture of the container;

forcing the peripheral edge portion of the grasped plates downwards beyond engagement of the peripheral tab in order that the grasped plates are no longer supported thereby;

sliding the grasped plates radially outward along the guide surface of the peripheral flange of the container through the bottom aperture so as to release the grasped plates from being supported upon the flange;

wherein the forcing downwards is by a warping of the grasped plates which is insufficient in magnitude so as to cause permanent deformation of the flexible plates.

8. The method according to claim 7 further comprising:

mounting the canister container at its top so that access to the bottom aperture of the canister is readily obtained.

9. A dispenser for flexible plates, each plate having a peripheral edge portion and a central portion extending downwardly therefrom comprising:

a generally cylindrical housing member adapted to be mounted to a horizontal support surface;

a generally cylindrical container sized for storing stacked flexible plates in an upright vertical orientation, the container formed having an interior region substantially complimentary to the periphery of the stacked flexible plates and including a generally cylindrical bottom aperture;

means for releasably attaching said cylindrical container to said housing member;

a peripheral flange formed about a substantial portion of the bottom aperture of the container, extending radially inward therefrom through a distance sufficient to engage the peripheral edge portion of a bottom one of the stacked plates in a generally contiguous orientation and support the stacked plates within the interior region of the cylindrical container, said flange further defining a guide surface for sliding selected bottom ones of said stacked plates radially outward from said container;

a pair of tabs formed adjacent the bottom aperture of the container disposed between opposite ends of said flange and extending radially inward through a distance sufficient to engage the peripheral edge portion of the bottom one plate;

an opening formed in the side wall of said cylindrical container extending axially upward along the side wall and positioned between said pair of tabs; and wherein the bottom aperture, the flange, and the pair of tabs permit selected bottom ones of the stacked flexible plates to be manually grasped at their peripheral edge portion adjacent said pair of tabs and be warped in order to cause such plates to pass downwardly beyond engagement with said pair of tabs and subsequently be slid radially outward along the guide surface of the peripheral flange until they no longer engage the flange.

* * * * *